US010519008B1

(12) United States Patent
Riley

(10) Patent No.: US 10,519,008 B1
(45) Date of Patent: Dec. 31, 2019

(54) CRANE LOAD CENTERING ASSEMBLY

(71) Applicant: Jim Riley, Loxahathchee, FL (US)

(72) Inventor: Jim Riley, Loxahathchee, FL (US)

( * ) Notice: Subject to any disclaimer, the term of this patent is extended or adjusted under 35 U.S.C. 154(b) by 36 days.

(21) Appl. No.: 16/012,330

(22) Filed: Jun. 19, 2018

(51) Int. Cl.

| | |
|---|---|
| ***B66C 13/46*** | (2006.01) |
| ***B66C 13/44*** | (2006.01) |
| ***B66C 13/08*** | (2006.01) |
| ***B66C 15/06*** | (2006.01) |

(52) U.S. Cl.
CPC ..... *B66C 13/46* (2013.01); *B66C 13/085* (2013.01); *B66C 13/44* (2013.01); *B66C 15/065* (2013.01)

(58) Field of Classification Search
CPC ..... B66C 13/00; B66C 13/04; B66C 13/06; B66C 13/063; B66C 13/46; B66C 15/065
USPC ..... 212/273, 276
See application file for complete search history.

(56) References Cited

U.S. PATENT DOCUMENTS

| | | | | |
|---|---|---|---|---|
| 3,826,380 | A * | 7/1974 | Lenander | B66C 13/063 212/273 |
| 4,273,243 | A | 6/1981 | Locher | |
| 4,471,877 | A | 9/1984 | Whitly | |
| 5,491,549 | A * | 2/1996 | Wichner | B66C 13/063 356/141.2 |
| 5,597,079 | A | 1/1997 | Konop | |
| 7,137,771 | B2 * | 11/2006 | Maurer | B66C 13/085 414/334 |
| 7,331,477 | B2 * | 2/2008 | Schulte | B66C 13/063 212/270 |
| 9,108,826 | B2 | 8/2015 | Eriksson | |
| D764,737 | S | 8/2016 | Ojapalo | |
| 2015/0249821 | A1 * | 9/2015 | Tanizumi | B60R 1/00 348/46 |
| 2016/0016763 | A1 * | 1/2016 | Lee | B66C 13/46 212/275 |
| 2016/0031682 | A1 * | 2/2016 | Sorensen | B66C 13/06 212/273 |

FOREIGN PATENT DOCUMENTS

| | | |
|---|---|---|
| WO | WO2016019289 | 2/2016 |

* cited by examiner

*Primary Examiner* — Michael R Mansen
*Assistant Examiner* — Juan J Campos, Jr.

(57) ABSTRACT

A crane load centering assembly includes a crane that has a boom, a sheave that is rotatably coupled to the boom and a load block. A transmitting unit is coupled to the sheave having the transmitting unit being directed downwardly from the sheave. The transmitting unit transmits an alignment signal along a line that is vertically oriented. In this way the alignment signal can travel in the direction of the force of gravity with respect to the boom. A plurality of sensors is provided and each of the sensors is coupled to the load block such that each of the sensors is positioned below and is aligned with the transmitting unit. One of the sensors receives the alignment signal when the crane lifts a load and the load deflects from beneath the sheave. A plurality of light emitters is provided and each of the light emitters is coupled to the load block. Each of the light emitters is in electrical communication with a respective one of the sensors and each of the light emitters has one of the sensors associated therewith. Each of the light emitters is turned on when the associated sensor receives the alignment signal to communicate a visual alert for the deflection of the load.

11 Claims, 6 Drawing Sheets

CRANE LOAD CENTERING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to centering devices and more particularly pertains to a new centering device for PURPOSE.

BRIEF SUMMARY OF THE INVENTION

An embodiment of the disclosure meets the needs presented above by generally comprising a crane that has a boom, a sheave that is rotatably coupled to the boom and a load block. A transmitting unit is coupled to the sheave having the transmitting unit being directed downwardly from the sheave. The transmitting unit transmits an alignment signal along a line that is vertically oriented. In this way the alignment signal can travel in the direction of the force of gravity with respect to the boom. A plurality of sensors is provided and each of the sensors is coupled to the load block such that each of the sensors is positioned below and is aligned with the transmitting unit. One of the sensors receives the alignment signal when the crane lifts a load and the load deflects from beneath the sheave. A plurality of light emitters is provided and each of the light emitters is coupled to the load block. Each of the light emitters is in electrical communication with a respective one of the sensors and each of the light emitters has one of the sensors associated therewith. Each of the light emitters is turned on when the associated sensor receives the alignment signal to communicate a visual alert for the deflection of the load.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
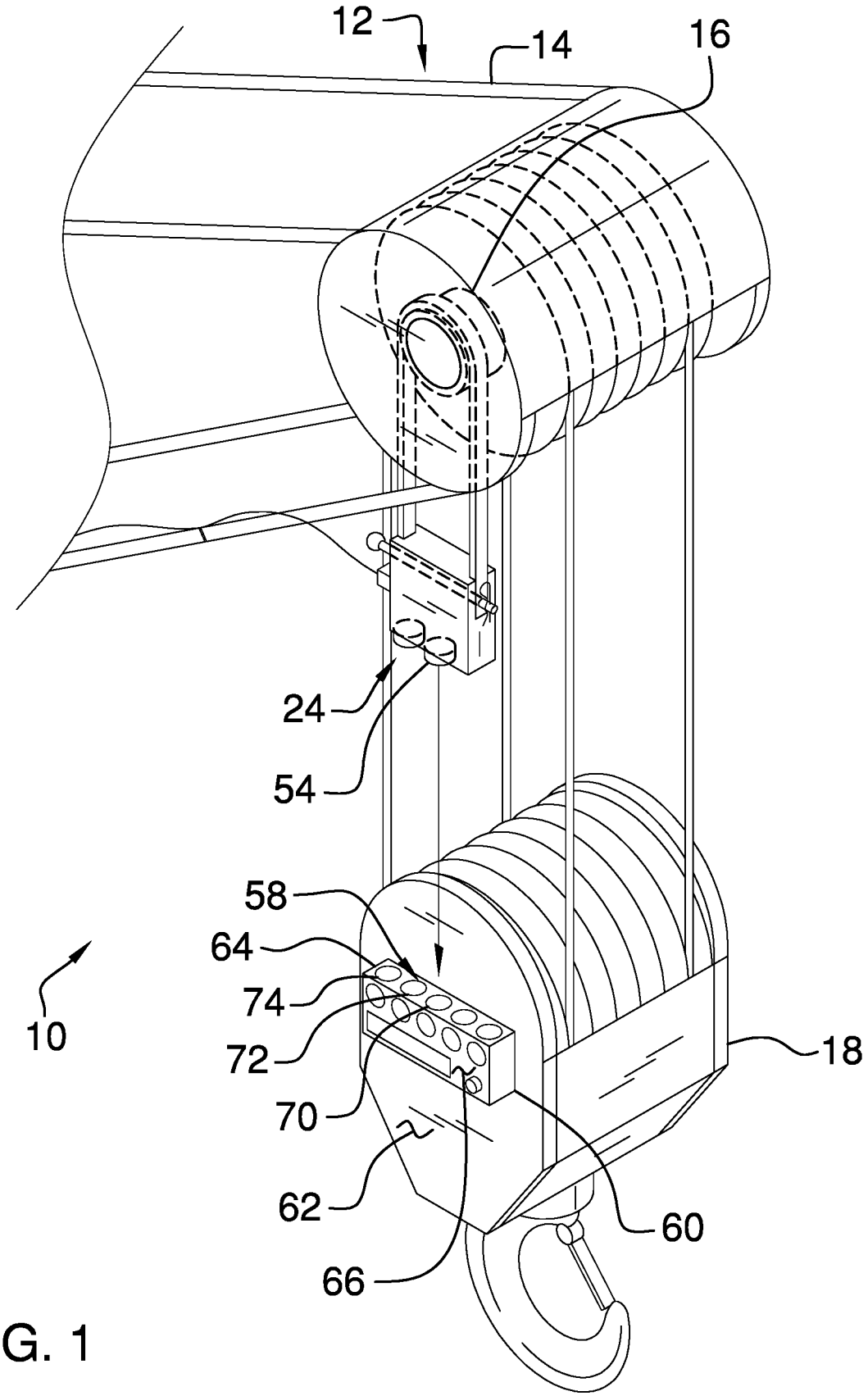
FIG. 1 is a perspective view of a crane load centering assembly according to an embodiment of the disclosure.
Figure 2:
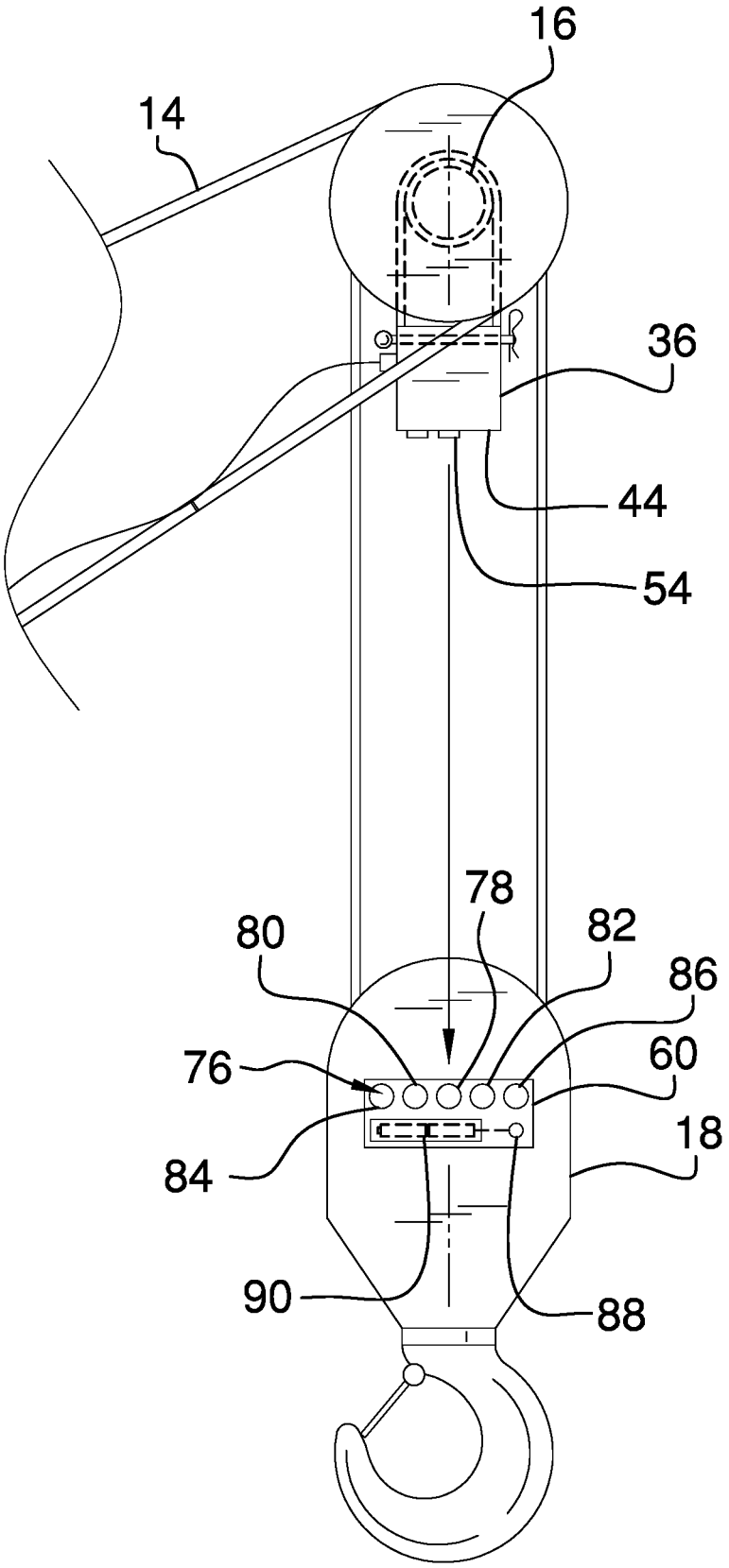
FIG. 2 is a right side view of an embodiment of the disclosure.
Figure 3:
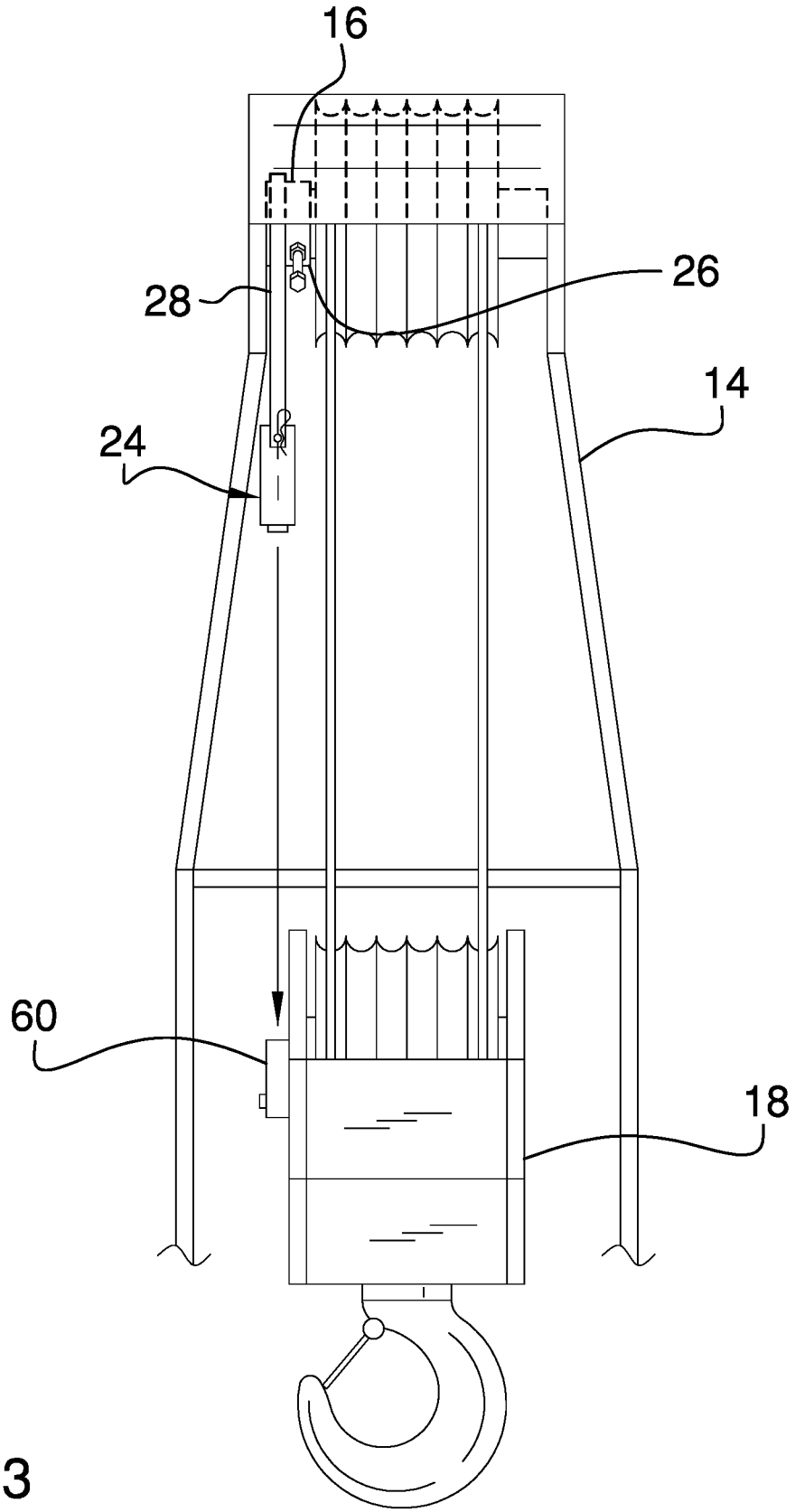
FIG. 3 is a front view of an embodiment of the disclosure.
Figure 4:
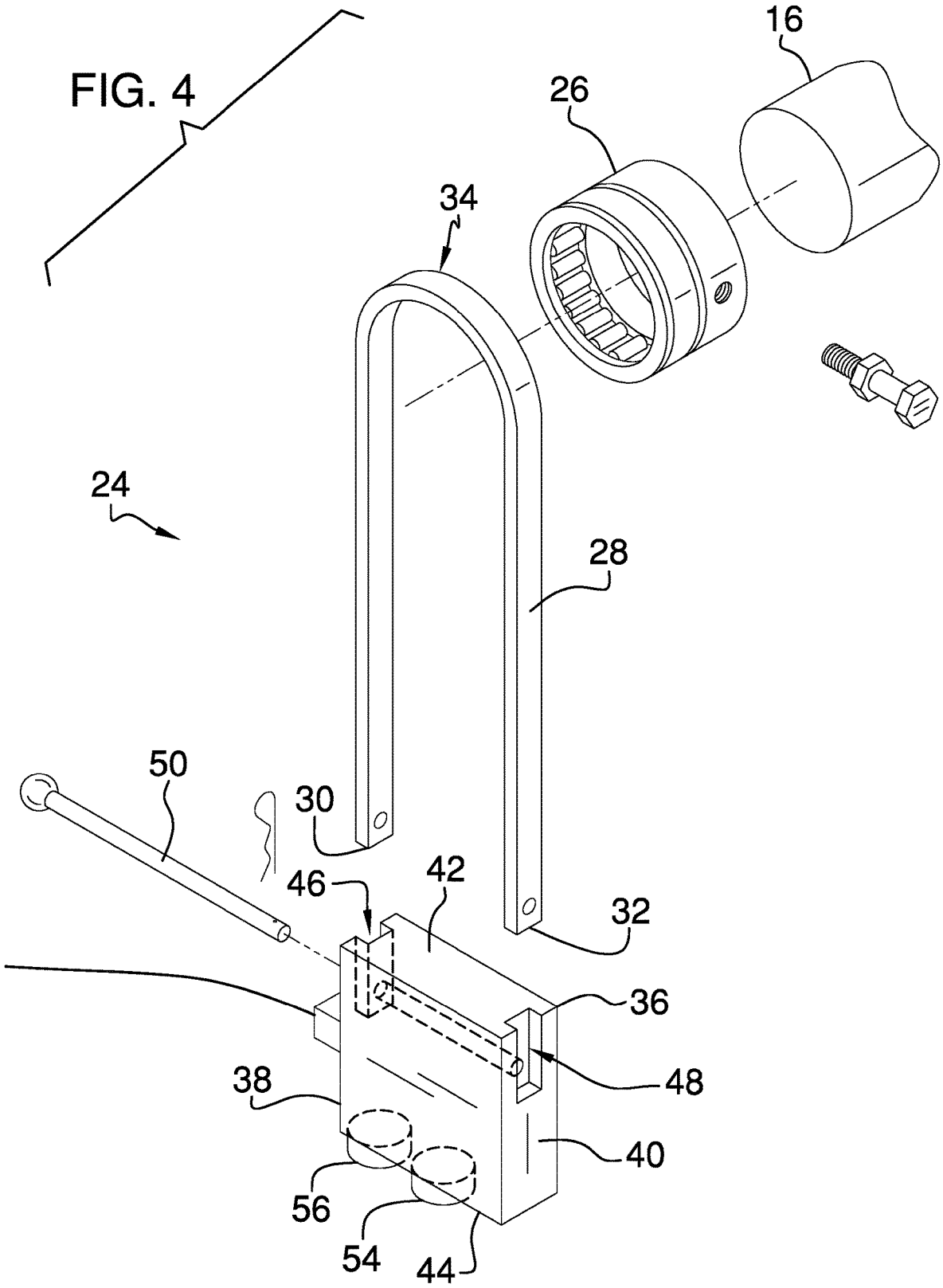
FIG. 4 is an exploded perspective view of a transmitting unit of an embodiment of the disclosure.
Figure 5:
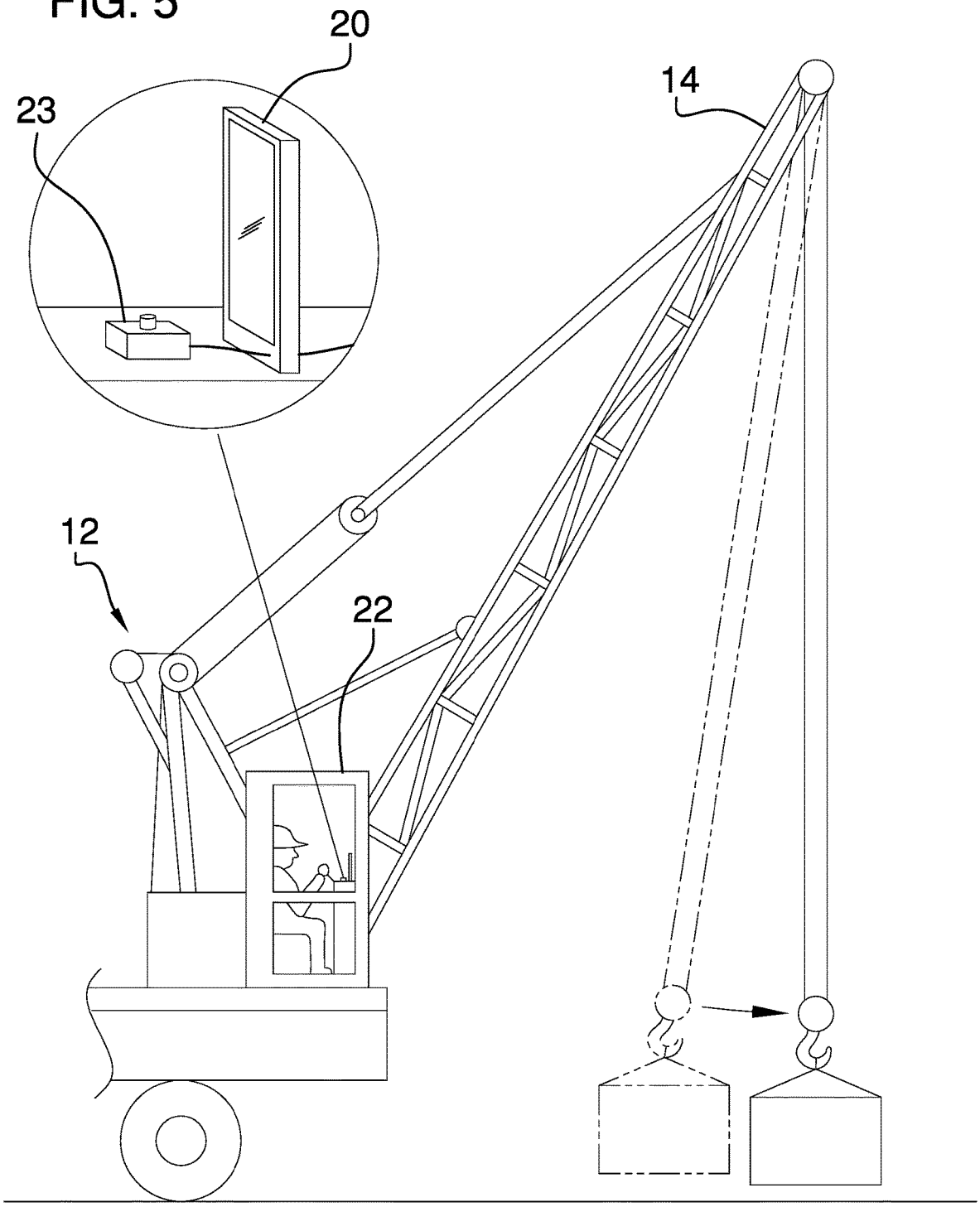
FIG. 5 is a perspective in-use view of an embodiment of the disclosure.
Figure 6:
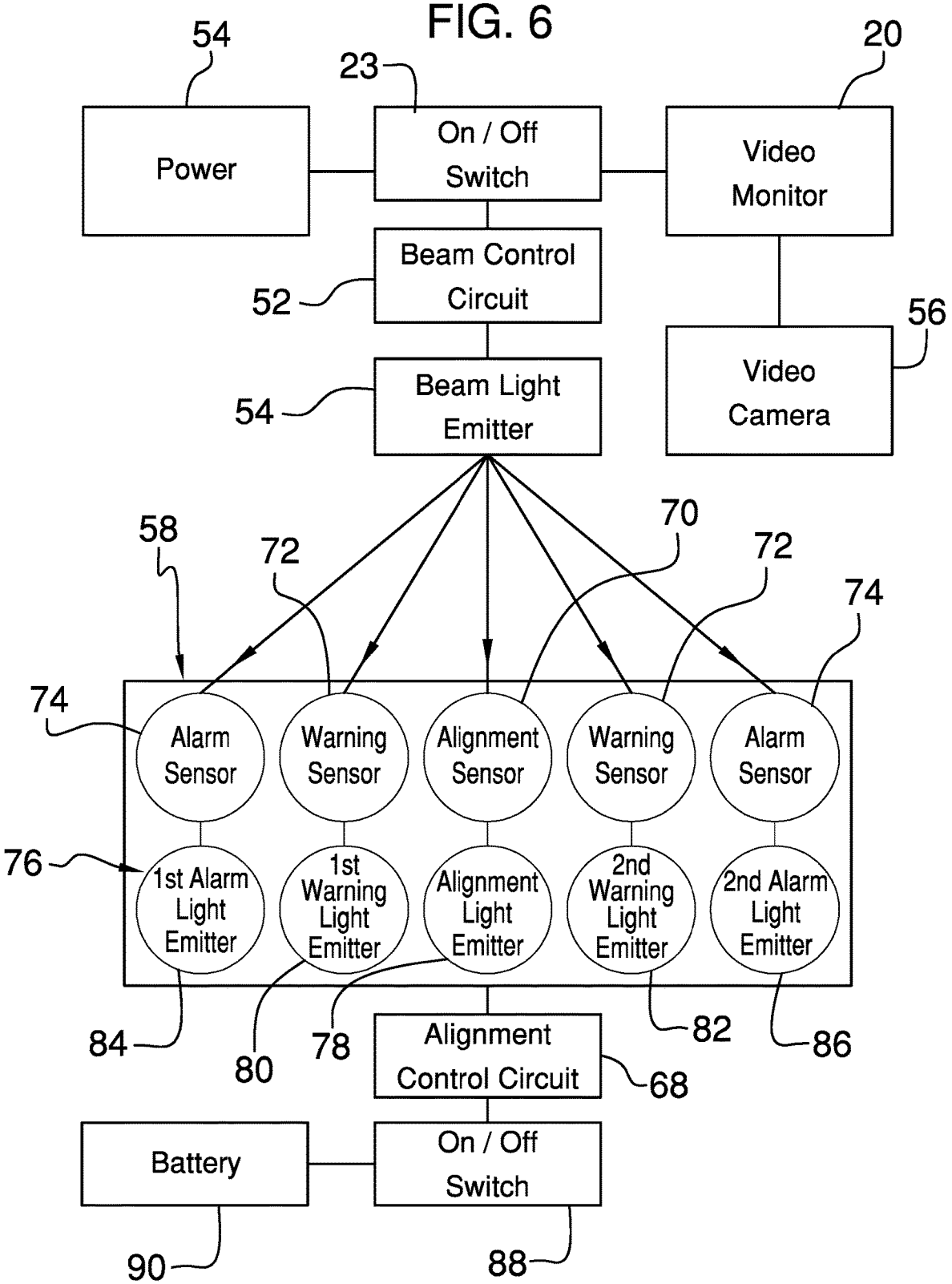
FIG. 6 is a schematic view of an embodiment of the disclosure.

With reference now to the drawings, and in particular to FIGS. 1 through 6 thereof, a new centering device embodying the principles and concepts of an embodiment of the disclosure and generally designated by the reference numeral 10 will be described.

As best illustrated in FIGS. 1 through 6, the crane load centering assembly 10 generally comprises a crane 12 that has a boom 14, a sheave 16 that is rotatably coupled to the boom 14 and a load block 18. A monitor 20 is positioned in a cab 22 of the crane 12 such that the monitor 20 is visible to a crane operator and a power button 23 is positioned in the cab 22 of the crane 12. The monitor 20 may be an electronic display, such as an LED display or the like. Additionally, the crane 12 may be a boom crane of any conventional design, including but not being limited to, mobile cranes and stationary cranes.

A transmitting unit 24 is coupled to the sheave 16 and the transmitting unit 24 is directed downwardly from the sheave 16. The transmitting unit 24 transmits an alignment signal along a line that is vertically oriented. Thus, the alignment signal travel in the direction of the force of gravity with respect to the sheave 16. The transmitting unit 24 comprises a bearing 26 that is rotatably positioned around the sheave 16. The bearing 26 may be a needle bearing or other ring bearing that has a stationary outer surface.

A strap 28 is provided that has a first end 30 and a second end 32, and the strap 28 has a bend 34 that is centrally positioned between the first 30 and second 32 ends. Thus, the first end 30 is spaced from the second end 32 giving the strap 28 a U-shape. The strap 28 is positioned on the bearing 26 has the bend 34 conforming to a curvature of the bearing 26 and having each of the first 30 and second 32 ends being directed downwardly. The bearing 26 inhibits the strap 28 from mechanically communicating with the sheave 16 when the sheave 16 is rotated.

A boom housing 36 is provided that has a first lateral wall 38, a second lateral wall 40, a top wall 42 and a bottom wall 44. The first lateral wall 38 has a first slot 46 therein extending from the top wall 42 toward the bottom wall 44 and the second lateral wall 40 has a second slot 48 therein extending from the top wall 42 toward the bottom wall 44. Each of the first 46 and second 48 slots insertably receives a respective one of the first 30 and second 32 ends of the strap 28. Moreover, each of the first 46 and second 48 slots restrains the boom housing 36 on the strap 28 by restricting the boom housing 36 from pivoting on the strap 28. A pin 50 is extendable through the boom housing 36 and engages the strap 28 to releasably retain the boom housing 36 on the strap 28.

A boom control circuit 52 is positioned within the boom housing 36 and the boom control circuit 52 is electrically coupled to a power source 54 comprising an electrical system of the crane 12. Additionally, the boom control circuit 52 is in electrical communication with the monitor 20 and the power button 23 in the cab 22. The electrical communication between the boom control circuit 52, the power source, the monitor 20 and the power button 23 may be accomplished with a wire harness that is releasably coupled between the boom housing 36 and the crane 12.

A boom light emitter 54 is coupled to the bottom wall 44 of the boom housing 36. The boom light emitter 54 emits a beam of light comprising the alignment signal downwardly from the bottom wall 44 of the boom housing 36. The boom light emitter 54 is electrically coupled to the boom control circuit 52 and the boom light emitter 54 may comprise a laser light emitter or the like. A video camera 56 is coupled to the bottom wall 44 of the boom housing 36 for capturing video images from a perspective looking downwardly from the sheave 16. The video camera 56 is electrically coupled to the boom control circuit 52 such that the monitor 20 displays the video images for the crane operator and the video camera 56 may be an electronic video camera 56 of any conventional design.

A plurality of sensors 58 is each coupled to the load block 18 such that each of the sensors 58 is positioned below and is aligned with the transmitting unit 24. One of the sensors 58 receives the alignment signal when the crane 12 lifts a load corresponding to a deflection of the load from the sheave 16. Moreover, the sensors 58 are arranged in a line that is oriented collinear with a direction in which the boom 14 extends from the cab 22 of the crane 12. In this way the sensors 58 can measure a degree to which the load deflects from the sheave 16. Each of the sensors 58 may comprise an electronic light sensor of any conventional design.

An alignment housing 60 is coupled to an outwardly facing surface 62 of the load block 18. The alignment housing 60 has a top surface 64 and a front surface 66, and the top surface 64 is directed toward the transmitting unit 24. An alignment control circuit 68 is positioned within the alignment housing 60. The plurality of sensors 58 includes an alignment sensor 70 that is coupled to the top surface 64 of the alignment housing 60 such that the alignment sensor 70 is positioned below and aligned with the boom light emitter 54. The alignment sensor 70 receives the alignment signal when the crane 12 lifts the load and the load is centered beneath the sheave 16. The alignment sensor 70 is electrically coupled to the alignment control circuit 68 and the alignment control circuit 68 receives an alignment input when the alignment sensor 70 receives the alignment signal.

The plurality of sensors 58 includes a pair of warning sensors 72. Each of the warning sensors 72 is coupled to the top surface 64 of the alignment housing 60 such that each of the warning sensors 72 is positioned below the boom light emitter 54. Each of the warning sensors 72 is positioned on a respective one of opposite sides of the alignment sensor 70. One of the warning sensors 72 receives the alignment signal when the crane 12 lifts the load and the load deviates a warning distance from beneath the sheave 16 toward the cab 22 of the crane 12 thereby communicating a first warning input to the alignment control circuit 68. Moreover, one of the warning sensors 72 receives the alignment signal when the crane 12 lifts the load and the load deviates a warning distance from beneath the sheave 16 away from the cab 22 thereby communicating a second warning input to the alignment control circuit 68.

The plurality of sensors 58 includes a pair of alarm sensors 74. Each of the alarm sensors 74 is coupled to the top surface 64 of the alignment housing 60 such that each of the alarm sensors 74 is positioned below the boom light emitter 54. Each of the alarm sensors 74 is positioned adjacent to a respective one of the warning sensors 72 such that each of the alarm sensors 74, each of the warning sensors 72 and the alignment sensor 70 forms a straight line. One the alarm sensors 74 receives the alignment signal when the crane 12 lifts the load and the load deviates an alarm distance from beneath the sheave 16 toward the cab 22 thereby communicating a first alarm input to the alignment control circuit 68. Additionally, one of the alarm sensors 74 receives the alignment signal when the crane 12 lifts the load and the load deviates an alarm distance from beneath the sheave 16 away from the cab 22 thereby communicating a second alarm input to the alignment control circuit 68.

A plurality of light emitters 76 is provided and each of the light emitters 76 is coupled to the load block 18. Each of the light emitters 76 is in electrical communication with a respective one of the sensors 58 and each of the light emitters 76 has one of the sensors 58 associated therewith. Moreover, each of the light emitters 76 is turned on when the associated sensor 58 receives the alignment signal. In this way the light emitters 76 communicate a visual alert for the deflection of the load. Each of the light emitters 76 may be an LED or the like.

The plurality of light emitters 76 includes an alignment light emitter 78 that is coupled to the front surface 66 of the alignment housing 60. The alignment light emitter 78 is electrically coupled to the alignment control circuit 68 and the alignment light emitter 78 is turned on when the alignment control circuit 68 receives the alignment input. Additionally, the alignment light emitter 78 may emit green light when the alignment light emitter 78 is turned on. A first warning light emitter 80 is coupled to the front surface 66 of the alignment housing 60 and the first warning light emitter 80 is electrically coupled to the alignment control circuit 68. The first warning light emitter 80 is turned on when the alignment control circuit 68 receives the first warning input.

A second warning light emitter 82 is coupled to the front surface 66 of the alignment housing 60 and the second warning light emitter 82 is electrically coupled to the alignment control circuit 68. The second warning light emitter 82 is turned on when the alignment control circuit 68 receives the second warning input. Each of the first 80 and second 82 warning light emitters may emit yellow colored light. A first alarm light emitter 84 is coupled to the front surface 66 of the alignment housing 60. The first alarm light emitter 84 is electrically coupled to the alignment control circuit 68 and the first alarm light emitter 84 is turned on when the alignment control circuit 68 receives the first alarm input.

A second alarm light emitter 86 is coupled to the load block 18 and the second alarm light emitter 86 is electrically coupled to the alignment control circuit 68. The second alarm light emitter 86 is turned on when the alignment control circuit 68 receives the second alarm input. Each of the first 84 and second 86 alarm light emitters may emit red light. A switch 88 is coupled to the load block 18, the switch 88 is electrically coupled to the alignment control circuit 68 and the switch 88 turning the alignment control circuit 68 on and off. A power supply 90 is coupled to the load block 18, the power supply 90 is electrically coupled to the alignment control circuit 68 and the power supply 90 comprises at least one battery.

In use, the power button 23 is manipulated to turn the boom light emitter 54 on when the crane 12 is lifting a load. Thus, the boom light emitter 54 emits the beam of light downwardly in the direction of gravity with respect to the sheave 16. The alignment light emitter 78 is turned on when the alignment control circuit 68 receives the alignment input. Thus, a spotter working with the crane operator is notified that the load is properly centered beneath the sheave 16 for lifting. The first warning light emitter 80 is turned on when the alignment control circuit 68 receives the first warning input. Thus, the spotter is notified that the load will deflect the warning distance toward the cab 22 when the load is lifted. The first alarm light emitter 84 is turned on when the alignment control circuit 68 receives the first alarm input. Thus, the spotter is notified that the load will deflect the alarm distance toward the cab 22 when the load is lifted thereby facilitating the crane operator to adjust the boom 14 to properly center the load.

The second warning light emitter 82 is turned on when the alignment control circuit 68 receives the second warning input. Thus, the spotter is notified that the load will deflect the warning distance away from the cab 22 when the load is lifted. The second alarm light emitter 86 is turned on when the alignment control circuit 68 receives the second alarm input. Thus, the spotter is notified that the load will deflect the alarm distance away the cab 22 when the load is lifted thereby facilitating the crane operator to adjust the boom 14 to properly center the load.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A crane load centering assembly being configured to assist a crane operator with precisely centering a load during a lift, the assembly comprising:

a crane having a boom, a sheave being rotatably coupled to the boom and a load block;

a monitor being positioned in a cab of the crane such that the monitor is visible to a crane operator;

a transmitting unit being coupled to the sheave having the transmitting unit being directed downwardly from the sheave, the transmitting unit transmitting a alignment signal along a line being vertically oriented wherein the alignment signal is configured to travel in the direction of the force of gravity with respect to the boom;

a plurality of sensors, each of the sensors being coupled to the load block such that each of the sensors is positioned below and is aligned with the transmitting unit, one of the sensors receiving the alignment signal when the crane lifts a load corresponding to a deflection of the load of center from the boom; and a plurality of light emitters, each of the light emitters being coupled to the load block, each of the light emitters being in electrical communication with a respective one of the sensors, each of the light emitters having one of the sensors being associated therewith, each of the light emitters being turned on when the associated sensor receives the alignment signal wherein the plurality of light emitters is configure to communicate a visual alert for the deflection of the load.

2. The assembly according to claim 1, wherein the transmitting unit comprises:

a bearing being rotatably positioned around the sheave;

a strap having a first end and a second end, the strap having a bend being centrally positioned between the first and second ends such that the first end is spaced from the second end giving the strap a U-shape, the strap being positioned on the bearing having the bend conforming to a curvature of the bearing and having each of the first and second ends being directed downwardly, the bearing inhibiting the strap from mechanically communicating with the sheave when the sheave is rotated;

a boom housing having a first lateral wall, a second lateral wall, a top wall and a bottom wall, the first lateral wall having a first slot therein extending from the top wall toward the bottom wall, the second lateral wall having a second slot therein extending from the top wall toward the bottom wall, each of the first and second slots insertably receiving a respective one of the first and second ends of the strap, each of the first and second slots restraining the boom housing on the strap; and a pin being extendable through the boom housing and engaging the strap to releasably retain the boom housing on the strap.

3. The assembly according to claim 2, further comprising:

a boom control circuit being positioned within the boom housing, the boom control circuit being electrically coupled to a power source comprising an electrical system of the crane, the boom control circuit being in electrical communication with the monitor;

a boom light emitter being coupled to the bottom wall of the boom housing, the boom light emitter emitting a beam of light comprising the alignment signal downwardly from the bottom wall of the boom housing, the boom light emitter being electrically coupled to the boom control circuit; and a video camera being coupled to the bottom wall of the boom housing wherein the video camera for capturing video images from a perspective looking downwardly from the sheave, the video camera being electrically coupled to the boom control circuit such that the monitor displays the video images for the crane operator.

4. The assembly according to claim 3, further comprising:

an alignment housing being coupled to an outwardly facing surface of the load block, the first alignment housing having a top surface and a front surface, the top surface being directed toward the transmitting unit; and an alignment control circuit being positioned within the alignment housing.

5. The assembly according to claim 4, wherein the plurality of sensors includes an alignment sensor being coupled to the top surface of the alignment housing such that the alignment sensor is positioned below and aligned with the boom light emitter, the alignment sensor receiving the alignment signal when the crane lifts a load and the load is centered beneath the boom, the alignment sensor being electrically coupled to the alignment control circuit, the alignment control circuit receiving an alignment input when the alignment sensor receives the alignment signal.

6. The assembly according to claim 5, wherein:

the plurality of sensors includes a pair of first warning sensors, each of the first warning sensors being coupled to the top surface of the alignment housing such that each of the first warning sensors is positioned below the boom light emitter, each of the first warning sensors being positioned on a respective one of opposite sides of the alignment sensor;

one of the first warning sensors receives the alignment signal when the crane lifts the load and the load deviates a warning distance off center from the boom toward the cab of the crane thereby communicating a first warning input to the alignment control circuit; and one of the first warning sensors receives the alignment signal when the crane lifts the load and the load deviates a warning distance off center from the boom away from the cab thereby communicating a second warning input to the alignment control circuit.

7. The assembly according to claim 6, wherein:

the plurality of sensors includes a pair of alarm sensors, each of the alarm sensors being coupled to the top surface of the alignment housing such that each of the alarm sensors is positioned below the boom light emitter, each of the alarm sensors being positioned adjacent to a respective one of the warning sensor such that each of the alarm sensors, each of the warning sensors and the alignment sensor forms a straight line;

one the alarm sensors receiving the alignment signal when the crane lifts the load and the load deviates an alarm distance off center from the boom toward the cab thereby communicating a first alarm input to the alignment control circuit; and one of the alarm sensors receiving the alignment signal when the crane lifts the load and the load deviates an alarm distance off center from the boom away from the cab thereby communicating a second alarm input to the alignment control circuit.

8. The assembly according to claim 4, wherein the plurality of light emitters includes an alignment light emitter being coupled to the load block, the alignment light emitter being electrically coupled to the alignment control circuit, the alignment light emitter being turned on when the alignment control circuit receives an alignment input.

9. The assembly according to claim 4, further comprising:

a first warning light emitter being coupled to the load block, the first warning light emitter being electrically coupled to the alignment control circuit, the first warning light emitter being turned on when the alignment control circuit receives a first warning input; and a second warning light emitter being coupled to the load block, the second warning light emitter being electrically coupled to the alignment control circuit, the second warning light emitter being turned on when the alignment control circuit receives a second warning input.

10. The assembly according to claim 4, further comprising a first alarm light emitter being coupled to the load block, the first alarm light emitter being electrically coupled to the alignment control circuit, the first alarm light emitter being turned on when the alignment control circuit receives a first alarm input; and a second alarm light emitter being coupled to the load block, the second alarm light emitter being electrically coupled to the alignment control circuit, the second alarm light emitter being turned on when the alignment control circuit receives a second alarm input.

11. A crane boom centering assembly being configured to assist a crane operator with precisely centering a load during a lift, the assembly comprising:

a crane having a boom, a sheave being rotatably coupled to the boom and a load block;

a monitor being positioned in a cab of the crane such that the monitor is visible to a crane operator;

a transmitting unit being coupled to the sheave having the transmitting unit being directed downwardly from the sheave, the transmitting unit transmitting an alignment signal along a line being vertically oriented wherein the alignment signal is configured to travel in the direction of the force of gravity with respect to the sheave, the transmitting unit comprising:

a bearing being rotatably positioned around the sheave;

a strap having a first end and a second end, the strap having a bend being centrally positioned between the first and second ends such that the first end is spaced from the second end giving the strap a U-shape, the strap being positioned on the bearing having the bend conforming to a curvature of the bearing and having each of the first and second ends being directed downwardly, the bearing inhibiting the strap from mechanically communicating with the sheave when the sheave is rotated;

a boom housing having a first lateral wall, a second lateral wall, a top wall and a bottom wall, the first lateral wall having a first slot therein extending from the top wall toward the bottom wall, the second lateral wall having a second slot therein extending from the top wall toward the bottom wall, each of the first and second slots insertably receiving a respective one of the first and second ends of the strap, each of the first and second slots restraining the boom housing on the strap;

a pin being extendable through the boom housing and engaging the strap to releasably retain the boom housing on the strap;

a boom control circuit being positioned within the boom housing, the boom control circuit being electrically coupled to a power source comprising an electrical system of the crane, the boom control circuit being in electrical communication with the monitor;

a boom light emitter being coupled to the bottom wall of the boom housing, the boom light emitter emitting a beam of light comprising the alignment signal downwardly from the bottom wall of the boom housing, the boom light emitter being electrically coupled to the boom control circuit; and a video camera being coupled to the bottom wall of the boom housing wherein the video camera for capturing video images from a perspective looking downwardly from the sheave, the video camera being electrically coupled to the boom control circuit such that the monitor displays the video images for the crane operator; and an alignment housing being coupled to an outwardly facing surface of the load block, the alignment housing having a top surface and a front surface, the top surface being directed toward the transmitting unit;

an alignment control circuit being positioned within the alignment housing;

a plurality of sensors, each of the sensors being coupled to the load block such that each of the sensors is positioned below and is aligned with the transmitting unit, one of the sensors receiving the alignment signal when the crane lifts a load corresponding to a deflection of the load of center from the boom, the plurality of sensors including:

an alignment sensor being coupled to the top surface of the alignment housing such that the alignment sensor is positioned below and aligned with the boom light emitter, the alignment sensor receiving the alignment signal when the crane lifts a load and the load is centered beneath the sheave, the alignment sensor being electrically coupled to the alignment control circuit, the alignment control circuit receiving an alignment input when the alignment sensor receives the alignment signal;

a pair of first warning sensors, each of the first warning sensors being coupled to the top surface of the alignment housing such that each of the first warning sensors is positioned below the boom light emitter, each of the first warning sensors being positioned on a respective one of opposite sides of the alignment sensor, one of the first warning sensors receiving the alignment signal when the crane lifts the load and the load deviates a warning distance off center from the boom toward the cab of the crane thereby communicating a first warning input to the alignment control circuit, one of the first warning sensors receiving the alignment signal when the crane lifts the load and the load deviates a warning distance from beneath the sheave away from the cab thereby communicating a second warning input to the alignment control circuit;

a pair of alarm sensors, each of the alarm sensors being coupled to the top surface of the alignment housing such that each of the alarm sensors is positioned below the boom light emitter, each of the alarm sensors being positioned adjacent to a respective one of the warning sensor such that each of the alarm sensors, each of the warning sensors and the alignment sensor forms a straight line, one the alarm sensors receiving the alignment signal when the crane lifts the load and the load deviates an alarm distance off center from the boom toward the cab thereby communicating a first alarm input to the alignment control circuit, one of the alarm sensors receiving the alignment signal when the crane lifts the load and the load deviates an alarm distance from beneath the sheave away from the cab thereby communicating a second alarm input to the alignment control circuit;

a plurality of light emitters, each of the light emitters being coupled to the load block, each of the light emitters being in electrical communication with a respective one of the sensors, each of the light emitters having one of the sensors being associated therewith, each of the light emitters being turned on when the associated sensor receives the alignment signal wherein the plurality of light emitters is configure to communicate a visual alert for the deflection of the load, the plurality of light emitters including:

an alignment light emitter being coupled to the load block, the alignment light emitter being electrically coupled to the alignment control circuit, the alignment light emitter being turned on when the alignment control circuit receives the alignment input;

a first warning light emitter being coupled to the load block, the first warning light emitter being electrically coupled to the alignment control circuit, the first warning light emitter being turned on when the alignment control circuit receives the first warning input;

a second warning light emitter being coupled to the load block, the second warning light emitter being electrically coupled to the alignment control circuit, the second warning light emitter being turned on when the alignment control circuit receives the second warning input;

a first alarm light emitter being coupled to the load block, the first alarm light emitter being electrically coupled to the alignment control circuit, the first alarm light emitter being turned on when the alignment control circuit receives the first alarm input;

a second alarm light emitter being coupled to the load block, the second alarm light emitter being electrically coupled to the alignment control circuit, the second alarm light emitter being turned on when the alignment control circuit receives the second alarm input;

a switch being coupled to the load block, the switch being electrically coupled to the alignment control circuit, the switch turning the alignment control circuit on and off; and a power supply being coupled to the load block, the power supply being electrically coupled to the alignment control circuit, the power supply comprising at least one battery.

* * * * *